United States Patent [19]

Wakabayashi et al.

[11] Patent Number: 4,995,431

[45] Date of Patent: Feb. 26, 1991

[54] APPARATUS FOR FILLING SPECIFIED AMOUNT OF LIQUID

[75] Inventors: Shigeru Wakabayashi; Yoshihiro Saijo; Yoshitaka Yamane; Yasuji Fujikawa, all of Tokushima, Japan

[73] Assignee: Shikoku Kakoki Co., Ltd., Tokushima, Japan

[21] Appl. No.: 490,247

[22] Filed: Mar. 8, 1990

[30] Foreign Application Priority Data

Mar. 24, 1989 [JP] Japan ..... 1-33489[U]

[51] Int. Cl.[5] ..... B67C 3/02

[52] U.S. Cl. ..... 141/116; 141/250; 239/570; 222/494

[58] Field of Search ..... 141/250, 255, 257-261, 141/266, 115-117, 284, 311 A, 86, 87; 222/255, 333, 330, 380, 504, 108-110, 275, 571, 491, 492, 494-497; 239/332, 350, 574, 583, 456, 570, 571

[56] References Cited

U.S. PATENT DOCUMENTS

| | | | |
|---|---|---|---|
| 3,831,821 | 8/1974 | Doyen | 141/261 X |
| 4,406,215 | 9/1983 | Lacasse | 92/85 R |
| 4,462,436 | 7/1984 | Rangwala | 141/250 |
| 4,537,335 | 8/1985 | Rangwala et al. | 222/496 |
| 4,798,337 | 1/1989 | Shimokawa | 239/570 |

FOREIGN PATENT DOCUMENTS

| | | | |
|---|---|---|---|
| 0138234 | 4/1985 | European Pat. Off. | 141/115 |

*Primary Examiner*—Henry J. Recla
*Assistant Examiner*—Casey Jacyna
*Attorney, Agent, or Firm*—Armstrong, Nikaido, Marmelstein, Kubovcik & Murray

[57] ABSTRACT

An apparatus for filling a specified amount of liquid comprises a vertical tubular filling nozzle, a damper attached to the lower end of the filling nozzle and pivotally movable upward and downward, a vertical rod supported upwardly and downwardly movably inside the filling nozzle, a connecting member connecting the free end of the damper to the lower end of the vertical rod, a spring biasing the vertical rod upward to hold the damper closed against the gravity on the liquid within the nozzle, and a metering cylinder for feeding the liquid to the nozzle in the specified amount at a time to open the damper against the spring. An annular seat facing downward is formed on the inner surface of the nozzle approximately at the midportion of its height. A liquid channel blocking annular member is mounted on the vertical rod so as to come into contact with the seat simultaneously when or immediately before the damper is closed. The volume of liquid fed from the metering cylinder to the nozzle at a time is greater than the volume of liquid to be accommodated in the nozzle in the portion thereof under the blocking member.

5 Claims, 3 Drawing Sheets

APPARATUS FOR FILLING SPECIFIED AMOUNT OF LIQUID

BACKGROUND OF THE INVENTION

The present invention relates to an apparatus for filling a fluid food or like liquid into containers each in a specified amount.

Such apparatus heretofore known include those of the type which comprise a vertical tubular filling nozzle, and a damper attached to the lower end of the filling nozzle and pivotally movable upward and downward.

The filling nozzle has at its lower end an opening which is closed with the damper or opened almost 100%, so that the apparatus is suited to a high-speed filling operation. Nevertheless, the apparatus has the problem of permitting variations in the amount of liquid to be filled since when the damper is closed, air flows into the filling nozzle from the lower-end opening and remains locally in portions of the liquid channel of the apparatus.

SUMMARY OF THE INVENTION

The main object of the present invention is to provide an apparatus for filling a liquid into containers each in a specified amount free of the above problem.

The apparatus embodying the invention for filling a specified amount of liquid comprises a vertical tubular filling nozzle having an annular seat facing downward and formed on the inner surface thereof approximately at the midportion of its height, a damper attached to the lower end of the filling nozzle and pivotally movable upward and downward, a vertical rod supported upwardly and downwardly movably inside the filling nozzle and extending through the seat inwardly thereof, a connecting member connecting the free end of the damper to the lower end of the vertical rod, a spring biasing the vertical rod upward to hold the damper closed against the gravity on the liquid within the filling nozzle, a liquid channel blocking annular member mounted on the vertical rod so as to come into contact with the seat simultaneously when or immediately before the damper is closed, and a metering cylinder for feeding the liquid to the filling nozzle in a volume at a time, the volume being greater than the volume of the liquid to be accommodated in the filling nozzle in the portion thereof under the blocking member.

With the apparatus of the present invention, the liquid channel blocking member comes into contact with the seat simultaneously when or immediately before the damper is closed, so that air, even if flowing into the nozzle from its lower end, will not ascend above the blocking member. When the liquid is fed from the metering cylinder to the filling nozzle in the subsequent filling cycle in a volume greater than the volume of liquid accommodated in the nozzle in the portion thereof under the blocking member, the air is discharged from the nozzle along with the liquid flowing out of the nozzle. This eliminates the likelihood of air remaining in the liquid channel of the apparatus, precluding variations in the amount of liquid to be filled.

BRIEF DESCRIPTION OF THE DRAWINGS

The drawings show an embodiment of the present invention.

DESCRIPTION OF THE PREFERRED EMBODIMENT

An embodiment of the invention will be described below with reference to the drawings.

Figure 1:
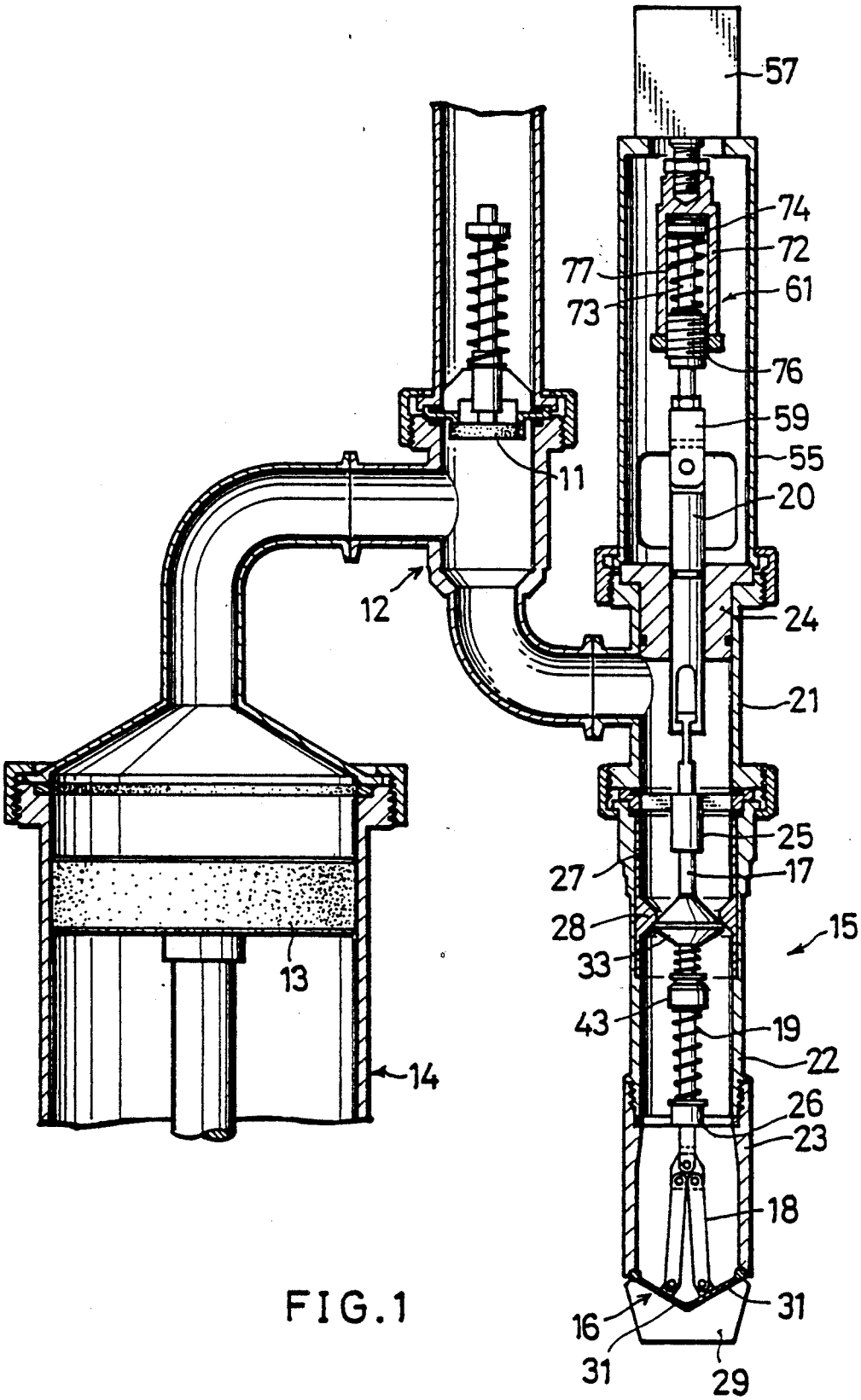
FIG. 1 is a view in vertical section.

FIG. 1 shows a filling apparatus which comprises a vertical filling cylinder 12 having a check valve 11 at its upper end and connected to an unillustrated tank containing the liquid to be filled, a metering cylinder 14 connected to the filling cylinder 12 approximately at the midportion of its height and housing a piston 13, a vertical tubular filling nozzle 15 connected to the lower end of the filling cylinder 12, a damper 16 attached to the lower end of the filling nozzle 15 and pivotally movable upward and downward, a vertical rod 17 upwardly and downwardly movably supported by the lower portion of the filling nozzle 15, a connecting member 18 connecting the free end of the damper 16 to the lower end of the vertical rod 17, a coiled compression spring 19 biasing the vertical rod 17 upward for closing the damper, and a lift rod 20 upwardly and downwardly movably supported by the upper portion of the filling nozzle 15 and disposed in alignment with the vertical rod 17.

The filling cylinder 12 and the metering cylinder 14 are well known and will therefore not be described in detail.

Figure 2:
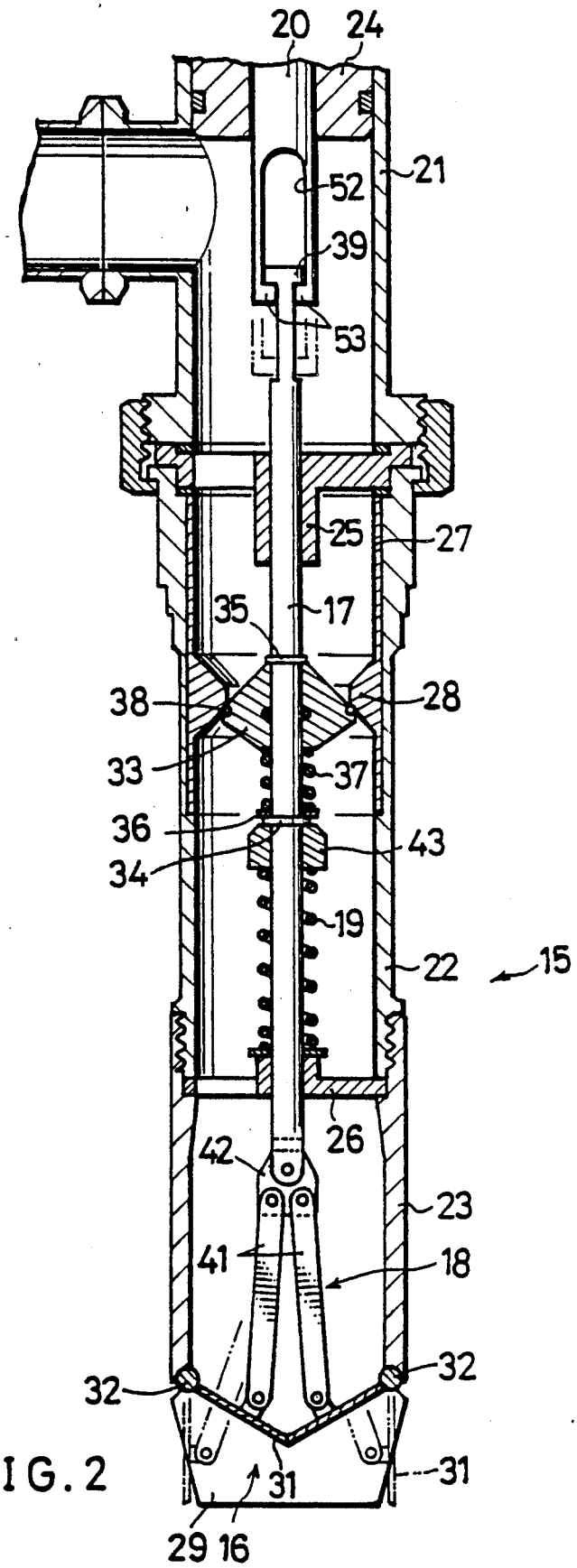
FIG. 2 is an enlarged fragmentary view in section of FIG. 1.

As shown in detail in FIG. 2, the filling nozzle 15 comprises an upper member 21, an intermediate member 22 and a lower member 23. The upper end of the upper member 21 is closed with a closure 24. The upper member 21, intermediate member 22 and lower member 23 are interconnected by fastening means. An upper guide member 25 is held between the upper member 21 and the intermediate member 22, and a lower guide member 26 between the intermediate member 22 and the lower member 23. These guide members 25, 26 guide the vertical rod 17 for upward and downward movement. The intermediate member 22 has a sleeve 27 inserted in its upper portion and formed on the inner surface thereof with an inwardly projecting annular seat 28 at an intermediate portion of the height thereof. The entire upper member 21 and intermediate member 22 and the lower portion of the lower member 23 are generally in the form of a hollow cylinder, while the lower portion of the lower member 23 is in the form of a tube having a quadrilateral cross section. Of the two pairs of opposed sides of the quadrilateral lower-end opening edge of the lower member 23, one pair is provided with opposed guide plates 29 extending downward and in the form of an inverted trapezoid.

The damper 16 comprises a pair of rectangular closure plates 31 positioned between the guide plates 29 and resembling a double-leafed hinged door. Each of the closure plates 31 has a horizontal pin 32 which is secured to its base end and opposite ends of which are rotatably supported by the opening edge of the lower member 23. When closed, the two closure plates 31 are V-shaped in cross section.

A liquid channel blocking annular member 33 is fitted to the vertical rod 17 approximately at the midportion of its height and is movable upward and downward relative to the rod 17. The blocking member 33 has conical upper and lower surfaces. The vertical rod 17 is provided with a flange 34 positioned below the blocking member 33 and an annular stopper 35 positioned above the member 33. A coiled compression spring 37 for holding the blocking member 33 is provided around the vertical rod 17 and positioned between the blocking member 33 and an annular spring holder 36 resting on the flange 34. The blocking member 33 is biased upward by the spring 37, such that the upper surface peripheral portion of the blocking member 33 is held in contact with the seat 28, with an almost invisible very small clearance formed between the upper end of the blocking member 33 and the stopper 35, while the damper is closed. An O-ring 38 is attached to the upper surface peripheral portion of the blocking member 33. When in contact with the seat 28, the blocking member 33 blocks the liquid channel inside the filling nozzle 15 approximately at the midportion of height thereof and also acts as a resistance member against the liquid flowing down the nozzle 15. Although the filling cylinder 12 conventionally needs to be provided with two check valves at the respective upper and lower ends thereof, the lower check valve can be dispensed with since the blocking member 33 serves the function of this valve. The volume of liquid to be accommodated in the filling nozzle 15 in the portion thereof under the blocking member 33 is smaller than the volume of liquid to be fed to the nozzle 15 by the metering cylinder 14 in one cycle of filling operation.

The upper end of the vertical rod 17 is positioned approximately at the midportion of height of the upper member 21 and has a flange serving as a downward engaging portion 39.

The connecting member 18 comprises a pair of connecting rods 41 which are connected at their upper ends to the lower end of the vertical rod 17 by an attaching member 42 and at their lower ends to the respective closure plates 31.

The coiled compression spring 19 for closing the damper 16 is provided around the vertical rod 17 and disposed between the lower guide member 26 and an annular spring holder 43 fitted around the rod 17 and positioned under the flange 34. The force of the spring 19 is so determined as to hold the damper 16 closed against the gravity on the liquid filled in the nozzle 15. The force of the spring 19 is considerably smaller than that of the coiled compression spring 37 for holding the blocking member 33.

The lift rod 20 slidably extends through the closure 24 and has its upper end projected upward beyond the closure 24. A vertical slit 52 extends upward from the lower end of the lift rod 20. The slit 52 has a length not smaller than a maximum length of stroke of the vertical rod 17 for opening and closing the damper 16. The downward engaging portion 39 is positioned in the slit 52. At the lower end of the lift rod 20, inward projections opposed to each other are formed on the respective side faces defining the slit 52 to provide an upward engaging portion 53 engageable with the downward engaging portion 39 from below.

Figure 3:
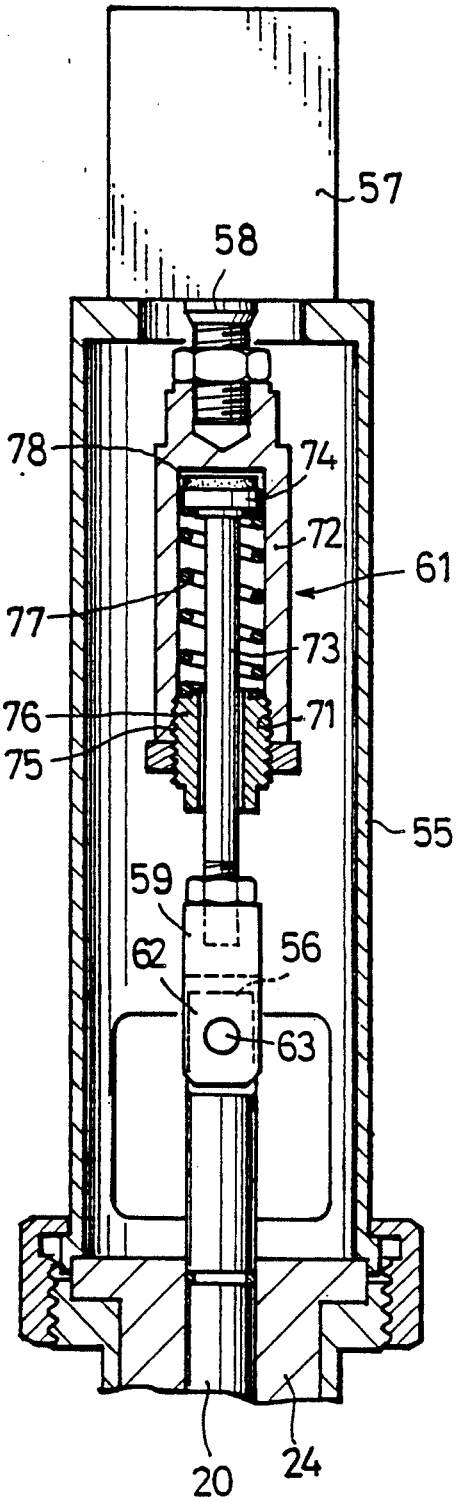
FIG. 3 is an enlarged fragmentary view in section of FIG. 1 showing a portion thereof different from that shown in FIG. 2.

As shown in detail in FIG. 3, a tubular yoke 55 is mounted on the upper end of the filling nozzle 15. The upper end of the lift rod 20 extending into the yoke 55 has a vertical flat thin plate portion 56. A hydraulic cylinder 57 is mounted on the upper end of the yoke 55 and has a piston rod 58 extending vertically downward into the yoke 55. The upper end of the rod 20 is connected to the piston rod 58 by a connector 59 and a bumper 61. The connector 59 is generally inverted U-shaped and holds the thin plate portion 56 of the rod 20 between the opposed walls 62 thereof. A horizontal connecting pin 63 extends through the plate portion 56 and the opposed walls 62 in this state.

The bumper 61 comprises vertical tubular housing 72 having a closed top end fastened to the piston rod 58 and a female screw 71 at its lower portion, a center rod 73 fixed at its lower end to the connector 59 and extending upward from the connector 59 into the housing 72, a spring holder 74 provided at the upper end of the rod 73, a short tubular spring retainer 76 fitted around the center rod 73 and having an externally threaded portion 75 screwed into the female screw 71, a bumper spring 77 provided around the center rod 73 and interposed between the spring holder 74 and the retainer 76, and a rubber cushion 78 affixed to the upper face of the spring holder 74.

The drawings show the filling nozzle 15 as filled with the liquid to be filled, with the damper 16 closed. In this state, the downward engaging portion 39 is in engagement with the upward engaging portion 53, and the lift rod 20 is in the upper limit position of its vertical stroke. The piston rod 58 of the hydraulic cylinder 57 is in its retracted position, with a clearance formed between the top wall of the housing 72 and the rubber cushion 78.

The damper 16 cannot be opened even if the liquid is fed from the metering cylinder 14 to the filling nozzle 15 in this state. Accordingly, before the liquid is fed from the cylinder 14 to the nozzle 15, the piston rod 58 of the hydraulic cylinder 57 is advanced to shift the lift rod 20 from the upper limit position to the lower limit position, whereby the two engaging portions 39, 53 are released from each other, rendering the vertical rod 17 free to descend. The liquid is then fed from the metering cylinder 14 to the filling nozzle 15, permitting the pressure of the liquid to act on the blocking member 33, which in turn is pushed down along with the rod 17. Consequently, the damper 16 is opened, allowing the liquid to flow out from the nozzle 16.

When the feed of the liquid from the metering cylinder 14 is discontinued to complete one cycle of filling operation, the spring 19 exerts an upward force on the vertical rod 17. At this time or slightly before or after this time, the hydraulic cylinder 57 is actuated to raise the lift rod 20. In the course of the upward movement, the two engaging portions 39, 58 come into engagement with each other, raising the vertical rod 17 to close the damper 16.

Immediately before the damper 16 is thus closed, the blocking member 33 comes into contact with the seat, blocking the liquid channel inside the nozzle 15. Accordingly, even if air flows into the nozzle 17 when the damper 16 is closed, the air will not ascend beyond the blocking member 33 but is discharged from the nozzle 15 in the subsequent filling cycle.

With the closing of the damper 16, the lift rod 20 stops rising. The housing 72 and the spring retainer 76 of the bumper 61 only are thereafter slightly moved upward along with the piston rod 58 to compress the bumper spring 77. This mitigates the impact acting on the damper 16, the vertical rod 17, the lift rod 20, etc when the damper 16 is closed.

While the invention has been particularly shown and described in reference to preferred embodiments thereof, it will be understood by those skilled in the art that changes in form and details may be made therein without departing from the spirit and scope of the invention.

What is claimed is:

1. An apparatus for filling a specified amount of liquid comprising:

a vertical tubular filling nozzle;

an annular seat coupled to the vertical tubular filling nozzle, the seat facing downward and being formed on the inner surface of the filling nozzle approximately at the midportion of the height thereof;

a damper attached to the lower end of the filling nozzle and pivotally movable upward and downward, the damper being closeable when the damper is moved upward;

a vertical rod supported upwardly and downwardly movably inside the filling nozzle and extending through the seat inwardly thereof;

a connecting member connecting the free end of the damper to the lower end of the vertical rod;

a spring biasing the vertical rod upward to hold the damper closed against the gravity on the liquid within the filling nozzle;

a liquid channel blocking annular member slidably mounted on the vertical rod and biasing means for biasing said member upwardly with respect to said rod such that when the vertical rod is moved upward, an upper peripheral surface of the member comes into abutment with the downwardly facing seat whereby said blocking member closes said filling nozzle simultaneously when or immediately before the damper is closed; and a metering cylinder for feeding the liquid to the filling nozzle in a volume at a time, the volume being greater than the volume of the liquid to be accommodated in the filling nozzle in the portion thereof under the blocking member.

2. An apparatus as defined in claim 1 wherein the blocking member is movable upward and downward relative to the vertical rod, and the vertical rod is provided with a stopper for restraining the blocking member from moving upward relative to the vertical rod, the stopper being positioned at a level not lower than the level of the upper end of the blocking member when the blocking member is in contact with the seat, the blocking member being biased upward by another spring.

3. An apparatus as defined in claim 1 or 2 further comprising:

a downward engaging portion provided at the upper end of the vertical rod, a lift rod provided at its lower end with an upward engaging portion engageable with the downward engaging portion from below, and lift means for vertically moving the lift rod between an upper limit position and a lower limit position while the feed of the liquid is discontinued, the upward engaging portion being in engagement with the downward engaging portion with the damper closed when the lift rod is in the upper limit position, the lower limit position being downwardly away from the upper limit position at least by the length of upward and downward stroke of the vertical rod for opening and closing the damper.

4. An apparatus as defined in claim 3 wherein the lift means includes a bumper for mitigating the impact acting on the damper, the vertical rod, the connecting member and the lift rod when the damper is closed.

5. An apparatus as defined in claim 3 wherein the filling nozzle has a closure covering the upper end thereof, and the upper end of the lift rod extends through the closure to project upward beyond the closure, the lift means comprising a hydraulic cylinder disposed above the lift rod, attached to the filling nozzle by a yoke and having a vertically downward piston rod, and a bumper connecting the upper end of the lift rod to the piston rod for mitigating the impact acting on the damper, the vertical rod, the connecting member and the lift rod when the damper is closed.

* * * * *